US009241393B2

(12) United States Patent
Urchuk et al.

(10) Patent No.: US 9,241,393 B2
(45) Date of Patent: Jan. 19, 2016

(54) DYNAMIC CONTROL OF RADIATION EMISSION

(71) Applicants: Analogic Corporation, Peabody, MA (US); Smiths Heimann GmbH, Wiesbaden (DE)

(72) Inventors: Steven Neil Urchuk, Melrose, MA (US); Stephen J. Quigley, East Hampstead, NH (US); Hans Weedon, Salem, MA (US); Aissa Abdulmagid, Billerica, MA (US); Knut Beneke, Ober-Olm (DE); Claus Meder, Rossdorf (DE); Dirk Naumann, Lorsch (DE)

(73) Assignee: ANALOGIC CORPORATION, Peabody, MA (US)

( * ) Notice: Subject to any disclaimer, the term of this patent is extended or adjusted under 35 U.S.C. 154(b) by 295 days.

(21) Appl. No.: 13/803,746

(22) Filed: Mar. 14, 2013

(65) Prior Publication Data

US 2014/0270081 A1 Sep. 18, 2014

(51) Int. Cl.

| | |
|---|---|
| ***H05G 1/32*** | (2006.01) |
| ***H05G 1/46*** | (2006.01) |
| ***H05G 1/08*** | (2006.01) |
| ***H05G 1/38*** | (2006.01) |
| *H05G 1/56* | (2006.01) |
| *H05G 1/62* | (2006.01) |

(52) U.S. Cl.

CPC ..... *H05G 1/085* (2013.01); *H05G 1/38* (2013.01); *H05G 1/46* (2013.01); *H05G 1/56* (2013.01); *H05G 1/62* (2013.01)

(58) Field of Classification Search

CPC ..... H05G 1/38; H05G 1/46

See application file for complete search history.

(56) References Cited

U.S. PATENT DOCUMENTS

| | | | | |
|---|---|---|---|---|
| 4,039,811 | A * | 8/1977 | Ennslin et al. | 378/112 |
| 4,104,526 | A | 8/1978 | Albert | |
| 4,378,501 | A | 3/1983 | Cowell | |
| 6,816,573 | B2 | 11/2004 | Hirano et al. | |
| 7,406,154 | B2 | 7/2008 | Resnick | |
| 2011/0051886 | A1 * | 3/2011 | Basu et al. | 378/8 |
| 2012/0187312 | A1 | 7/2012 | Guez | |
| 2013/0182934 | A1 * | 7/2013 | Topfer et al. | 382/132 |

* cited by examiner

*Primary Examiner* — Glen Kao
*Assistant Examiner* — Dani Fox
(74) *Attorney, Agent, or Firm* — Cooper Legal Group, LLC

(57) ABSTRACT

Among other things, one or more techniques and/or systems for selectively inhibiting radiation from being generated by a radiation source are provided. A radiation source comprises an electrically conductive gate situated between a cathode and an anode. When a voltage potential is created between the gate and the cathode, a flow of electrons between the cathode and the anode is mitigated, thus inhibiting radiation from being generated by the radiation source. When the voltage potential is removed or lessened, electrons may more freely flow between the cathode and the anode to generate radiation. In some embodiments, a calibration, such as a dark calibration, may be performed while the gate mitigates the flow of electrons. Moreover, in some embodiments, an accelerating voltage applied to the radiation source may be held substantially constant when radiation is generated as well as when radiation generation is inhibited.

17 Claims, 6 Drawing Sheets

DYNAMIC CONTROL OF RADIATION EMISSION

BACKGROUND

The present application relates to the field of radiation scanning and/or radiation imaging. It finds particular application with threat detection systems and/or explosive detection systems (EDS), such as those used to inspect baggage at security checkpoints. It also relates to other applications where it is desirable to inhibit the emission of radiation during an examination of an object or between an examination of a first object and an examination of a second object to perform a calibration procedure, comply with radiation emission regulations and/or conserve energy, for example.

Radiation systems, such as computed tomography (CT) systems, tomography systems, diffraction systems, projection systems, and/or line systems, for example, are used to provide information pertaining to interior aspects of an object. Generally, the object is exposed to radiation comprising photons (e.g., such as x-ray photons, gamma ray photons, etc.) to measure attenuation by the object or aspects of the object that interact with the radiation. Generally, highly dense aspects of an object absorb and/or attenuate more radiation than less dense aspects, and thus an aspect having a higher density, such as a bone or metal, for example, may be apparent when surrounded by less dense aspects, such as muscle or clothing.

In some applications, it is desirable to periodically or intermittently inhibit radiation from entering an examination region of the radiation system. For example, in some security applications, regulations may mandate that radiation systems inhibit radiation from being emitted into the examination region when no object is being examined (e.g., to limit radiation exposure during such instances). As another example, it may be desirable to limit exposure of a detector array to radiation during an offset calibration (e.g., also referred to as a dark calibration) when the system is measuring a response of the detector array when no radiation is being detected.

Several approaches have been used to inhibit radiation from entering an examination region and impinging upon a detector array. For example, according to one approach, a mechanical shutter is positioned proximate a focal spot (e.g., an opening) in a radiation source. When it is desirable to inhibit radiation from entering the examination region, an actuator adjusts one or more fins of the mechanical shutter, causing the fins to shield the focal spot and inhibit radiation from escaping the radiation source. Another approach has been to reduce an accelerating voltage applied to the radiation source (e.g., from an operating voltage of 180 kV to 0 V), effectively powering down the power supply, when it is desirable to inhibit radiation from entering the examination region. While such approaches have proven effective, both approaches have some disadvantages. For example, the mechanical fins are often slow to open/close and/or fail under rotation, and large swings in the voltage applied by the power source may be harmful to the power supply, radiation source, and/or other electrical components of the radiation system.

SUMMARY

Aspects of the present application address the above matters, and others. According to one aspect, a radiation system is provided. The radiation system comprises a radiation source comprising a cathode and an anode. The radiation source is configured to accelerate electrons between the cathode and the anode to generate radiation. The radiation system also comprises an electrically conductive gate situated between the cathode and the anode. The gate is configured to mitigate a flow of electrons between the cathode and the anode when a bias is applied to the gate, such that a gate voltage applied to the gate is different than a cathode voltage applied to the cathode, to inhibit the generation of radiation from the radiation source.

According to another aspect, a method for inhibiting radiation from being generated between an examination of a first object and an examination of a second object is provided. The method comprises identifying an instance where no objects are in an examination region of a radiation system. The method also comprises applying a bias, during the instance, to an electrically conductive gate situated between a cathode and an anode of a radiation source of the radiation system to inhibit radiation from being generated by the radiation source.

According to yet another aspect, a radiation source is provided. The radiation source comprises an anode, a cathode, and an electrically conductive gate. The radiation source is configured to generate radiation based upon electron flow between the cathode and the anode. The electrically conductive gate is configured to inhibit the generation of radiation while an accelerating voltage is applied to at least one of the cathode or the anode.

Those of ordinary skill in the art may appreciate still other aspects of the present application upon reading and understanding the appended description.

FIGURES

The application is illustrated by way of example and not limitation in the figures of the accompanying drawings, in which like references generally indicate like elements and in which.

DETAILED DESCRIPTION

Figure 1:
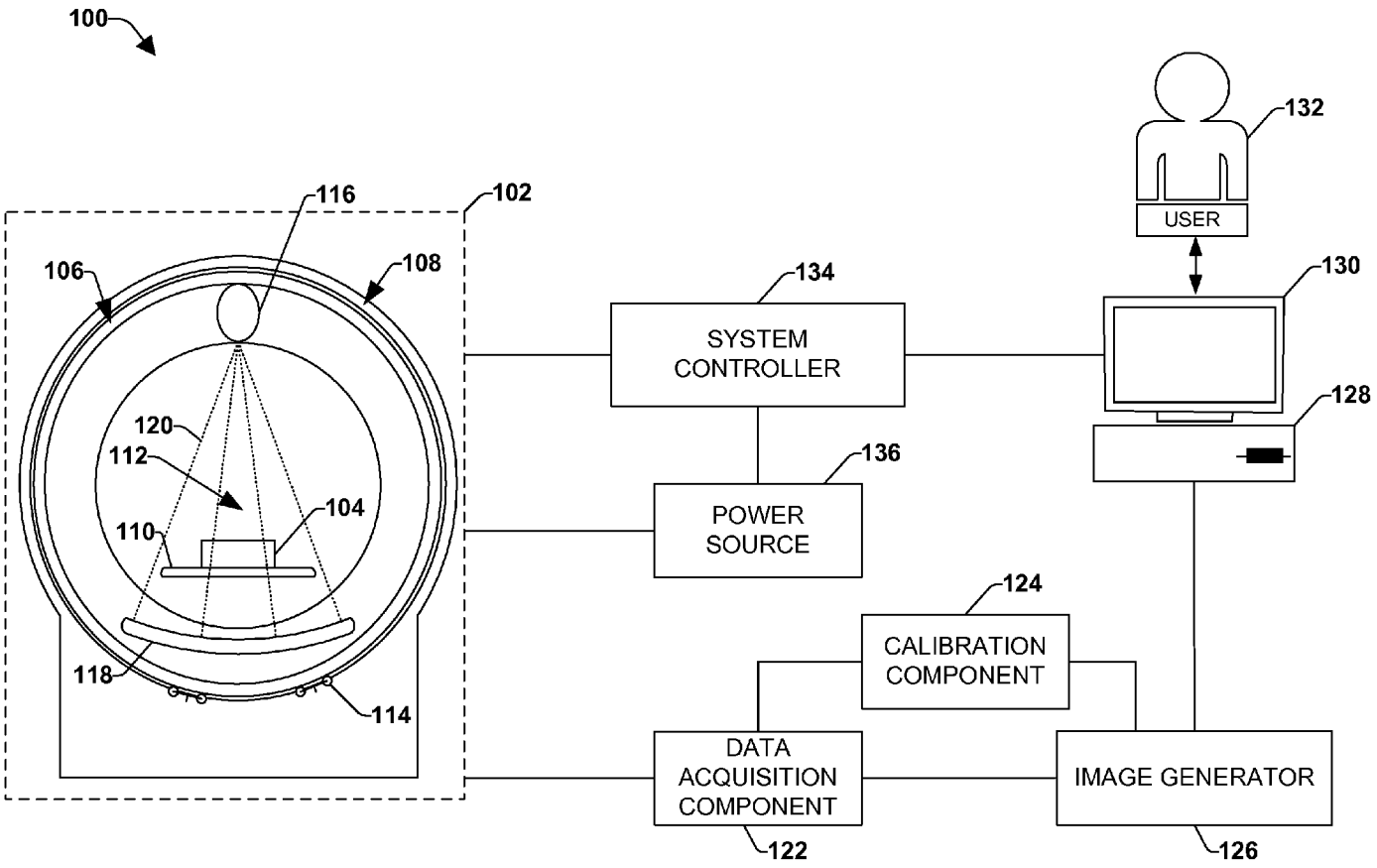
FIG. 1 is a schematic block diagram illustrating an example environment where a radiation system such as described herein may be implemented.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It may be evident, however, that the claimed subject matter may be practiced without these specific details. In other instances, structures and devices are illustrated in block diagram form in order to facilitate describing the claimed subject matter.

A radiation source typically comprises a cathode and an anode. Electrons flowing out of the cathode are accelerated when an accelerating voltage (e.g., typically a voltage of about 30 kV to 180 kV or more depending upon a desired energy spectrum of the emitted radiation) is applied to the radiation source to create a voltage potential between the cathode and the anode. Conventionally, the anode is grounded and the accelerating voltage is applied to the cathode. Radiation is generated from electrons that impinge the anode at a focal spot. Radiation that escapes through an opening in the radiation source is emitted into an examination region.

One or more systems and/or techniques are provided herein to dynamically control the emission of radiation into an examination region of a radiation system, such as a radiation imaging system or radiation treatment system. The systems and/or techniques described herein find particular application with threat detection systems and/or explosive detection systems (EDS) used in security environments. However, the systems and/or techniques may also find application in other environments, such as medical environments and/or industrial environments where it is desirable to dynamically control the emission of radiation into an examination region and/or to dynamically control the exposure of a detector array to radiation.

An electrically conductive gate, such as a grid formed by one or more wires or one or more cups, is situated between the cathode and the anode of a radiation source. When a bias, such as a negative bias, is applied to the gate (e.g., creating a potential voltage between the cathode and the gate), the gate is configured to mitigate a flow of electrons between the cathode and the anode. Accordingly, while the bias is applied (e.g., and the gate is enabled), few electrons, if any, impinge the anode and little to no radiation is generated. When it is desirable to resume radiation generation, the bias is removed or reduced (e.g., removing or reducing the voltage potential between the cathode and the gate), to facilitate a flow of electrons between the cathode and the anode. Accordingly, in some embodiments, the gate may be regarded as an electronic shutter controlling a flow of electrons between the cathode and the anode. In some embodiments, the gate may be a focusing electrode or electrodes.

FIG. 1 illustrates an example environment 100 of a radiation system as provided for herein. It may be appreciated that the example environment 100 merely provides an example arrangement and is not intended to be interpreted in a limiting manner, such as necessarily specifying the location, inclusion, and/or relative position of the components depicted therein. By way of example, the data acquisition component 122 may be part of the detector array 118. Moreover, the instant application is not intended to be limited to use with a particular radiation measurement technique and/or a particular type of radiation system. For example, the systems and/or techniques described herein may find applicability to, among other things, charge-integrating radiation systems, photon counting radiation systems, single-energy radiation systems, multi-energy (dual-energy) radiation systems, indirect conversion radiation systems, and/or direct conversion radiation systems.

In the example environment 100, an examination unit 102 of the radiation system is configured to examine objects 104 (e.g., bags, suitcases, patients, etc.). By way of example, the examination unit 102 may be configured to examine a series of bags placed on a conveyor belt and conveyed through the radiation system. As another example, the examination unit 102 may be configured to examine patients translated into the examination unit 102 via a gurney.

The examination unit 102 can comprise a rotating gantry 106 and a (stationary) support structure 108 (e.g., which may encase and/or surround at least a portion of the rotating gantry 106 (e.g., as illustrated with an outer, stationary ring, surrounding an outside edge of an inner, rotating ring)). An object 104 can be placed on a support article 110 of the examination unit 102, such as a gurney or conveyor belt, and conveyed or translated into an examination region 112 (e.g., a hollow bore in the rotating gantry 106 through which radiation is emitted). The rotating gantry 106 can be rotated about the object 104 during the examination and/or can be moved relative to the object 104 by a rotator 114, such as a motor, drive shaft, chain, roller truck, etc.

A radiation source 116 (e.g., an ionizing radiation source such as an x-ray source) is typically mounted on a substantially diametrically opposite side of the examination unit 102 relative to the detector array 118 (e.g., such that radiation emitted from the radiation source 116 traverses through the object 104 and the support article 110 and is detected at the detector array 118). In embodiments where the examination unit 102 comprises a rotating gantry 106, the radiation source 116 and detector array 118 may be mounted approximately 180 degrees apart on the rotating gantry 106 and may be configured to rotate with the rotating gantry 106. In this way, the rotating gantry 106 may be configured to rotate the radiation source 116 and/or the detector array 118 relative to the object 104 while the position of the radiation source(s) 116 relative to the detector array 118 is maintained during an examination of the object 104, for example.

During the examination of the object 104, the radiation source 116 emits fan, cone, wedge, and/or other shaped radiation flux 120 configurations from a focal spot(s) of the radiation source 116 (e.g., a region within or opening of the radiation source 116 from which radiation 120 emanates) into the examination region 112. It may be appreciated that such radiation 120 may be emitted substantially continuously and/or may be emitted intermittently or periodically (e.g., a brief pulse of radiation 120 is emitted followed by a resting period during which the radiation source 116 is not activated).

When an object 104 is not being examined and/or during other instances when it is desirable to inhibit radiation from entering the examination region 112, the radiation source 116 is configured to inhibit the generation of radiation 120. For example, during an offset calibration that is performed by a calibration component 124 to acquire one or more offset measurements, the radiation source 116 may be configured to inhibit the generation of radiation to allow the radiation system to measure a response of the detector array 118 when no radiation is being detected. As another example, the radiation source 116 may be configured to inhibit the generation of radiation when no objects are in the examination region 112, such as between the examination of a first bag and the examination of the second bag. In some embodiments, the generation of radiation is inhibited without altering an accelerating voltage (e.g., a voltage configured to cause an acceleration of electrons sufficient to generate radiation) that is applied to at least one of the cathode or the anode of the radiation source 116.

As emitted radiation 120 traverses the object 104, the emitted radiation 120 may be attenuated differently by different aspects of the object 104. Because different aspects attenuate different percentages of the emitted radiation 120, an image (s) of the object 104 may be generated based upon the attenuation, or variations in the number of photons that are detected by the detector array 118. For example, more dense aspects of the object 104, such as a bone or metal plate, may attenuate more of the emitted radiation 120 (e.g., causing fewer photons to strike the detector array 118) than less dense aspects, such as skin or clothing.

Radiation detected by the detector array 118 may be directly converted and/or indirectly converted into analog signals that can be transmitted from the detector array 118 to a data acquisition component 122 operably coupled to the detector array 118. The analog signal(s) may carry information indicative of the radiation detected by the detector array 118 (e.g., such as an amount of charge measured over a sampling period, an energy level of detected radiation, etc.), and the data acquisition component 122 may be configured to convert the analog signals into digital signals and/or to compile signals that were transmitted within a predetermined time interval, or measurement interval, using various techniques (e.g., integration, photon counting, etc.). The compiled signals are typically in projection space and are, at times, referred to as projections.

In the example environment 100, an image generator 126 (e.g., or image reconstructor) is configured to receive the projections output from the data acquisition component 122 and to generate one or more images based upon the projections. In some embodiments, prior to using a projection to generate an image, one or more correction factors are applied to measurements of the projection to adjust the measurements and/or account for errors in the measurements. By way of example, one or more correction factors may be derived by a calibration component 124 based upon an offset calibration performed by the calibration component 124 (e.g., when the detector array 118 is uniformly exposed to emitted radiation 120) and/or a dark calibration performed by the calibration component 124 (e.g., when the detector array 118 is exposed to no radiation) and may be applied to measurements of projections acquired during an examination of the object 104. In other embodiments, one or more correction factors derived based upon an offset calibration and/or dark calibration, are applied to a generated image (e.g., to reduce image artifacts in the image).

The projections or corrected projections are converted to images using a suitable analytical, iterative, and/or other image generation technique (e.g., backprojection reconstruction, tomosynthesis reconstruction, iterative reconstruction, etc.). In this way, an object 104 under examination is represented in image space rather than projection space, where image space may be more understandable by a user 132 than projection space, for example.

It may be appreciated that where the position of the radiation source 116 and/or the detector array 118 change relative to an object 104 during the examination (e.g., due to the rotation of the radiation source 116 and/or detector array 118 about the object 104), volumetric data indicative of the object 104 may be yielded from the measurements generated by the detector array 118. Accordingly, the image(s) generated by the image generator 126 may be three-dimensional images (e.g., also referred to as volumetric images), for example. Further, in some embodiments, the image generator 126 may be configured to project the volumetric images to generate two-dimensional images.

The example environment 100 further comprises a terminal 128, or workstation (e.g., a computer), that may be configured to receive images generated by the image generator 126. At least some of the received images may be provided by the terminal 128 for display on a monitor 130 to a user 132 (e.g., security personnel, medical personnel, etc.). In this way, the user 132 can inspect the image(s) to identify areas of interest within an object 104 undergoing examination, for example. The terminal 128 can also be configured to receive user input which can direct operations of the examination unit 102 (e.g., a speed to rotate, a speed and direction of a support article 110, etc.), for example.

In the example environment 100, a system controller 134 is operably coupled to the terminal 128. The system controller 134 may be configured to control operations of the examination unit 102. By way of example, in some embodiments, the system controller 134 may be configured to receive information from the terminal 128 and to issue instructions to the examination unit 102 indicative of the received information (e.g., adjust a speed of a conveyor belt). In other embodiments, the system controller 134 may be configured to provide instructions to a power source 136 configured to supply power to the examination unit 102. For example, the system controller 134 may provide instructions to the power source 136 regarding when to apply a voltage that inhibits the radiation source 116 from generating radiation and when not to apply such a voltage.

Figure 2:
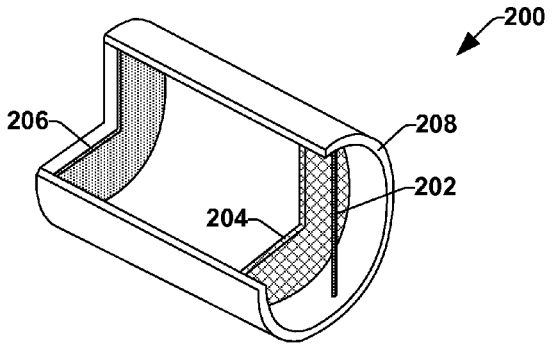
FIG. 2 illustrates an example radiation source.

Referring to FIG. 2, an example radiation source 200 (e.g., 116 in FIG. 1) is illustrated. The radiation source 200 comprises a cathode 202, a gate 204, and an anode 206, which are encased in a radiation shielding material 208, such as lead. It may be appreciated that an end-cap (adjacent the cathode 202) and cross-sectional slice extending along a longitudinal axis (e.g., extending from the cathode 202 to the anode 206) of the radiation source 200 have been removed to illustrate interior content of the radiation source 200.

The radiation source 200 is typically a vacuum tube and the cathode 202, gate 204, and anode 206 are positioned within an interior of the vacuum tube. A current is supplied to the cathode 202 to stimulate thermionic emission of electrons, which flow out of the cathode 202. When an accelerating voltage is applied to the radiation source 200, a voltage potential is created between the cathode 202 and the anode 206 and electrons accelerate from the cathode 202 toward the anode 206. Electrons that collide with the anode 206 cause radiation, such as X-ray radiation, to be generated.

In some embodiments, at least one of the cathode 202 or the anode 206 is grounded and the accelerating voltage is applied to whichever element of the cathode 202 or the anode 206 is not grounded. In other embodiments, a first accelerating voltage may be applied to the cathode 202 and a second accelerating voltage may be applied the anode 206 to create a desired voltage potential (e.g., where the desired voltage potential may be a function of a desired energy spectrum of emitted radiation).

The gate 204 is positioned between the cathode 202 and the anode 206 and is configured to control a flow of electrons between the cathode 202 and the anode 206. For example, when the gate 204 is enabled, the gate 204 is configured to mitigate a flow of electrons between the cathode 202 and the anode 206 (e.g., thus inhibiting the generation of radiation). When the gate 206 is disabled, the gate 206 is configured to create little to no interference with the flow of electrons (e.g., thus not inhibiting the generation of radiation).

The gate 204 is enabled when a bias is applied to the gate 204 to create a voltage potential between the cathode 202 and the gate 204. That is, the gate 204 is enabled when a gate voltage applied to the gate 204 is different than a cathode voltage applied to the cathode 202 (e.g., causing the gate 204 to be biased relative to the cathode 202). The degree of biasing required to repel electrons and/or to mitigate the flow of electrons between the cathode 202 and the anode 206 may be a function of, among other things, the accelerating voltage applied to the radiation source 200 and/or a degree to which it is desirable to reduce the flow of electrons. For example, a bias of 5 V may repel few, if any, electrons. Conversely, a bias of 1200 V may repel a high percentage of electrons. In some embodiments, the bias applied to the gate 204 is a negative bias. Thus, the gate voltage is less than the cathode voltage.

The gate 204 is constructed of an electrically conductive material, such as nickel, stainless steel, copper, and/or other metals that act as a focusing electrode, for example. In some embodiments, the gate 204 is constructed of metal wire woven to form a grid-like structure. In other embodiments, the gate 204 is constructed of a metal cup extending along a diameter of the radiation source 200. In still other embodiments, the gate 204 may be configured in various other configurations that, when biased, produce an electrical field that repels electrons and mitigates the flow of electrons between the cathode 202 and the anode 206.

Figure 3:
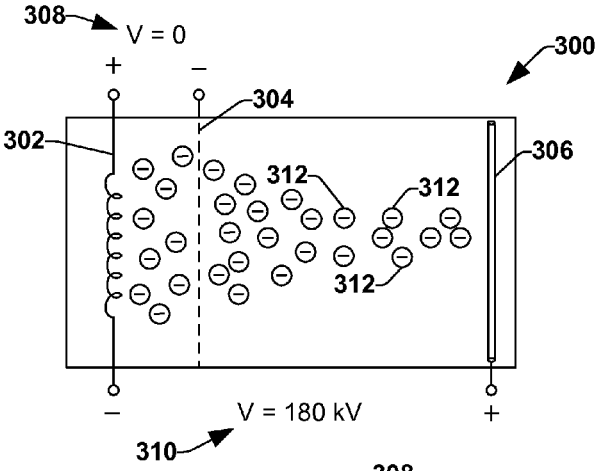
FIG. 3 is a block diagram of an example radiation source when a gate is disabled.
Figure 4:
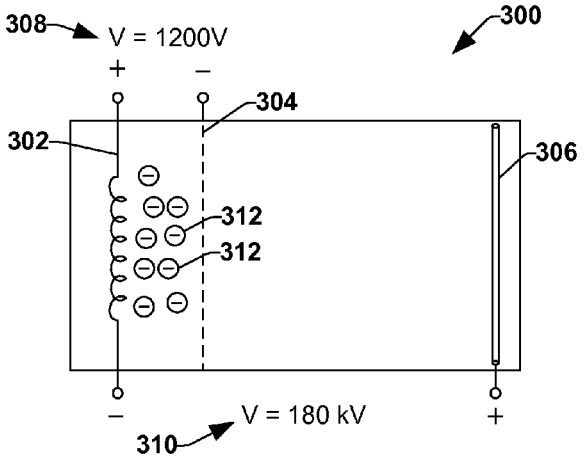
FIG. 4 is a block diagram of an example radiation source when a gate is enabled.

Referring to FIGS. 3 and 4, a diagram of an example radiation source 300 (e.g., 200 in FIG. 2) is illustrated. The radiation source 300 comprises a cathode 302 (e.g., 202 in FIG. 2), a gate 304 (e.g., 204 in FIG. 3), and an anode 306 (206 in FIG. 3). FIG. 3 illustrates an instance where the gate 304 in disabled. FIG. 4 illustrates an instance where the gate 304 is enabled.

Turning initially to FIG. 3, the radiation source 300 is shown during an instance when the gate 304 is disabled. The gate 304 is disabled when little to no bias is applied to the gate 304, causing a voltage potential 308 between the cathode 302 and the gate 304 to be substantially zero. Stated differently, the gate 304 is disabled when a cathode voltage applied to the cathode 302 is substantially equal to a gate voltage applied to the gate 304. Accordingly, when an accelerating voltage is applied to at least one of the cathode 302 and the anode 306, creating a voltage potential 310 between the cathode 302 and the anode 306, electrons 312 flow substantially unimpeded between the cathode 302 and the anode 306, allowing radiation to be produced. In the illustrated embodiment, the voltage potential 310 between the cathode 302 and the anode 306 is 180 kV. In other embodiments, the voltage potential 310 may be greater than or less than 180 kV. Moreover, it may be appreciated that although the example provides for zero voltage potential 308 between the cathode 302 and the gate 304, in some embodiments a bias is applied to the gate 304 when the gate is disabled (e.g., although the bias may be insufficient to repel a significant percentage of the electrons 312).

Turning to FIG. 4, the radiation source 300 is shown during an instance when the gate 304 is enabled. The gate 304 is enabled when a bias is applied to the gate 304, causing a voltage potential 308 between the cathode 302 and the gate 304 to exceed a threshold. In some embodiments, the threshold corresponds to a ratio, $\mu$, that suppresses or inhibits the flow of electrons 312 from the cathode 302 to anode 306, where $\mu$ is a function of the voltage potential 310 and the voltage potential 308. In some embodiments, $\mu$ can be as much as 500 or more. In the illustrated embodiment, the gate 304 is enabled when a bias of negative 1200 V is applied to the gate 304, to create a voltage potential 308 of 1200 V, while a voltage potential 310 of 180 kV is present between the cathode 302 and the anode 306, resulting in a $\mu$=150 (e.g., 180 kV divided by 1200 V).

When the gate 304 is enabled, electron flow between the cathode 302 and the anode 304 is mitigated. Accordingly, the gate 304 impedes electrons 312 from colliding with the anode 306 and inhibits radiation from being produced. Although the illustrated embodiment depicts the gate 304 as preventing any electrons 312 from traversing the gate 304 and colliding with the anode 306, in some embodiments, at least some electrons 312 may traverse the gate 304 when the gate 304 is enabled. Thus, mitigating the flow of electrons 312 is not intended to preclude a possibility that at least some electrons 312 will flow from the cathode 302 to the anode 306 and cause radiation to be generated. For example, in some embodiments, the use of a gate 304 to mitigate the flow of electrons reduces radiation emission from the radiation source 300 by a factor of 50,000, which may be substantially equivalent to a radiation level that is measured when a power source configured to apply the accelerating voltage to the radiation source 300 is turned off.

It may be appreciated that, in some embodiments, the accelerating voltage may be applied to at least one of the cathode 302 or the anode 306 when the gate 304 is enabled and when the gate 304 is disabled. For example, in the illustrated embodiment, the voltage potential 310 between the cathode 302 and the anode 306 is substantially unchanged between when the gate 304 is disabled (as shown in FIG. 3) and when the gate is enabled (as shown in FIG. 4). In other embodiments, the voltage potential 310 between the cathode 302 and the anode 306 when the gate 304 is disabled may be different than the voltage potential 310 between the cathode and the anode 306 when the gate 304 is enabled. For example, in some embodiments, the accelerating voltage is decreased such that the voltage potential 310 is decreased (e.g., but not eliminated) when the gate 304 is enabled.

Figure 5:
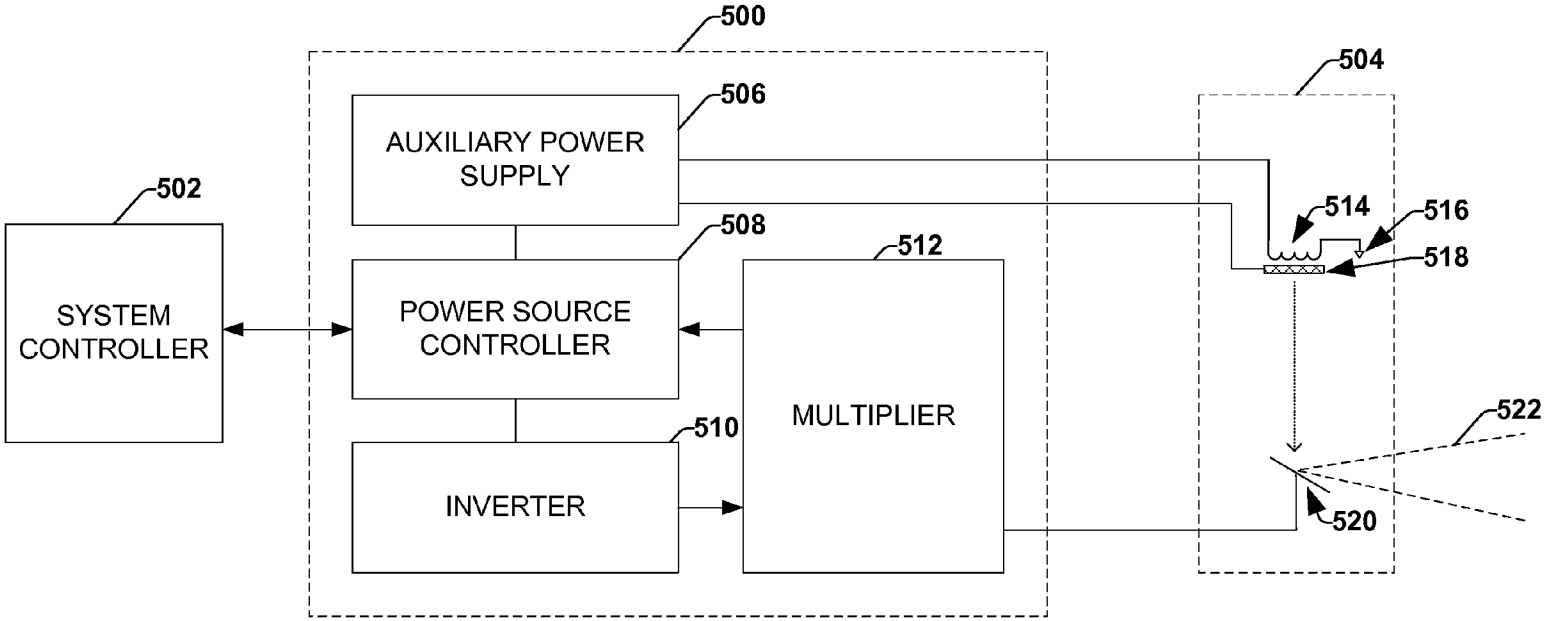
FIG. 5 illustrates an example power source.

FIG. 5 is a component block diagram illustrating an example power source 500 (e.g., 136 in FIG. 1) of a radiation system configured to supply power to a radiation source 504 (e.g., 200 in FIG. 2). In the illustrated embodiment, a cathode 514 (e.g., 302 in FIG. 3) is coupled to ground 516. Accordingly, an accelerating voltage is applied to an anode 520 of the radiation source 504 by the power source 500 to accelerate electrons within the radiation source 504. In other embodiments, the accelerating voltage is applied to the cathode 514 and the anode 520 is coupled to ground. In still other embodiments, a first accelerating voltage is applied to the anode 520 and a second accelerating voltage is applied to the cathode 514.

The power source 500 is operably coupled to a system controller 502 (134 in FIG. 1) of the radiation system, which is configured to provide requests to the power source 500 regarding desired operations to be performed by the power source 500. In some embodiments, the system controller 502 is configured to provide request to the power source 500 related to the enabling or disabling a gate 518 (e.g., 304 in FIG. 3) of the radiation source 504. By way of example, the system controller 502 may be operably coupled to one or more object sensors (e.g., positioned adjacent an examination region (e.g., 112 in FIG. 1)) configured to generate object position information indicative of the positions of objects to be examined relative to the examination region. When the system controller 502 identifies, from the object position information, that an object is approaching the examination region, the system controller 502 may be configured to issue a request to the power source 500 requesting that the power source 500 disable the gate 518 (e.g., to allow radiation to be generated). As another example, when the system controller 502 identifies, from the object position information, a window of time, between the examination of a first object and an examination of a second object, of a specified length, the system controller 502 may be configured to issue a request to the power source 500 requesting that the power source 500 enabled the gate 518 (e.g., to inhibit radiation from being generated when no object is being examined).

In other embodiments, the system controller 502 is configured to provide request to the power source 500 regarding a desired current to be supplied to the cathode 514 of the radiation source 504 and/or a desired accelerating voltage to be applied to the anode 520 (e.g., to emit radiation 522 at a desired radiation energy spectrum). For example, the system controller 502 may request that the power source 500 increase the accelerating voltage to increase an energy spectrum of radiation 522 (e.g., 120 in FIG. 5) output by the radiation source 504. Other example operations that may be requested by the system controller 502 include a power-down operation (e.g., to turn-off the power source 500) and/or a power-up operation (e.g., to turn-on the power source 500).

The power source 500 is configured to supply power to the radiation source 504 and to control whether the gate 518 is enabled or disabled. In the example embodiment, the power source 500 comprises an auxiliary power supply 506, a power source controller 508, an inverter 510, and a multiplier 512.

The power source controller 508 is configured to receive a request from the system controller 502 and to translate the request into instructions for one or more other components of the power source 500. By way of example, the power source controller 508 may receive a request from the system controller 502 indicative a desire to change an accelerating voltage from a first accelerating voltage to a second accelerating voltage. Based upon this request, the power source controller 508 may be configured to generate one or more instructions for altering a waveform output by the inverter 510.

As another example, the power source controller 508 may be configured to receive a request from the system controller 502 indicative of a desire to enable the gate 518 to inhibit radiation from being generated by the radiation source 504. Upon receipt of this request, the power source controller 508 may be configured to provide one or more instructions to the auxiliary power supply 506. Such instructions may provide for enabling the gate (e.g., by altering a voltage applied to the gate 518) and/or provide for preparing the auxiliary power supply 506 to alter a current supplied to the cathode 514 (e.g., such as by ramping up a current supplied to the cathode 514).

The inverter 510 is operably coupled to a DC power supply (not shown) and is configured to convert DC power provided from the DC power supply to AC power using one or more power conversion techniques. The AC power is output from the inverter 510 and supplied to the multiplier 512. In some embodiments, one or more properties of the AC power, such as a voltage and/or a frequency, may be controlled by the power source controller 508. For example, the inverter 510 may be configured to receive instructions from the power source controller 508 indicative of a desired voltage and/or frequency of the AC power, and the inverter 510 may convert the DC power to AC power according to the received instructions to achieve a desired AC output.

The AC power output from the inverter 510 is supplied to the multiplier 512 configured to produce the accelerating voltage. More particularly, the multiplier 212 is configured to convert the AC power having a first voltage to DC power having a second voltage using one or more voltage multiplication techniques, where the second voltage is substantially equivalent to the accelerating voltage. For example, in some embodiments, the inverter 510 and multiplier 512 are configured to convert DC power having a voltage of approximately 350 volts to DC power having a voltage of approximately 180 kV or more (e.g., multiplying the incoming voltage by a factor of 514 or more) to achieve a desired accelerating voltage, which may be applied by the multiplier 512 to the radiation source 504, or to the anode 520 of the radiation source 504.

In the illustrated embodiment, the multiplier 512 is further configured to output a feedback signal to the power source controller 508 indicative of the output of the multiplier 512 to the radiation source 504. By way of example, in some embodiments, the multiplier 512 is configured to apply a feedback voltage to the power source controller 508 that is related to (e.g., proportional to) the accelerating voltage applied to the anode 520. Based upon the feedback, the power source controller 508 may be configured to instruct the inverter 510 to alter a characteristic of the inverter 510, such as a switching frequency, to facilitate a change to a property of the AC signal output by the inverter 510. For example, when the multiplier 512 indicates that a voltage of 178 kV is being applied to the anode 520 and the power source controller 508 desires a voltage of 180 kV to be applied to the anode 520, the power source controller 508 may issue an instruction to the inverter 510 requesting the inverter 510 to alter a switching frequency such that a property of the output waveform is altered (e.g., to cause an accelerating voltage of 180 kV to be generated by the multiplier 512). In this way, a feedback loop is created between the power source controller 508, the inverter 510, and the multiplier 512. In some embodiments, the bandwidth of the feedback loop is wide enough such that the AC signal output by the inverter 510 can be adjusted to compensate for changes in anode 520 current.

The example power source 200 further comprises an auxiliary power supply 506 configured to apply a gate voltage to the gate 518. In some embodiments, a bias is created between the gate 518 and the cathode 516 when the gate voltage is applied by the auxiliary power supply 506. For example, in the illustrated embodiment, the cathode 514 is coupled to ground 516. Accordingly, when the auxiliary power supply 506 applies a negative gate voltage or a positive gate voltage to the gate 518, a bias is applied to the gate (e.g., due to the voltage potential between the cathode 514 and the gate 518). When the auxiliary power supply 506 applies a gate voltage of substantially zero to the gate 518, no bias is applied to the gate 518. In other embodiments, the gate 518 may be coupled to ground and the auxiliary power supply 506 is configured to apply a voltage to the cathode 514 to bias the gate 518.

In some embodiments, the auxiliary power supply 506 is configured to generate the gate voltage as a function of instructions supplied to the auxiliary power supply 506 via the power source controller 508. For example, when an object is not being examined (e.g., as indicated by the system controller 502), the power source controller 508 may instruct the auxiliary power supply 506 to increase the gate voltage such that a bias is applied to the gate 518 to inhibit radiation generation. When an object is being examined and/or is about to be examined, the power source controller 508 may instruct the auxiliary power supply 506 to not apply the bias to the gate 518 (e.g., or apply a smaller bias to the gate 518). In this way, the auxiliary power supply 506 is configured to alter the gate voltage relative to the cathode voltage to alter a voltage potential between the cathode 514 and the gate 518 and affect an electrical field produced by the gate 518, for example. In some embodiments, the auxiliary power supply 506 is configured to apply a gate voltage of between about negative 2000 V and about 0 V.

The auxiliary power supply 506 is further configured to supply a current to the cathode 514 to excite electrons. In some embodiments, the current that is supplied may be between about 3 A and about 5 A. It may be appreciated that although the example power source 500 provides for a single power supply that both applies the gate voltage and supplies current to the cathode 514, in other embodiments, the functions performed by the auxiliary power supply 506 may be divided into two or more power supplies. For example, a first auxiliary power supply 506 may be configured to supply current to the cathode 514 and a second auxiliary power supply may be configured to apply a gate voltage to the gate 518.

It may be appreciated that when a current is applied to the cathode 514 and the gate 518 is disabled, the power source 500 may be in a loaded state. Due to the accelerating voltage, the power drawn by the radiation source 504 while the power source is in the loaded state may exceed 1 kW. When the gate is enabled (e.g., effectively creating an open circuit between the cathode 514 and the anode 520), the power source 500 may be in a substantially non-loaded state, reducing power consumption and/or waste heat generation.

To lessen an effect on the power source 500 when moving between a loaded state and a non-loaded state, in some embodiments, the power source 500 is configured to gradually transition between the loaded state, when the bias is not applied, and the substantially non-loaded state, when the bias is applied. For example, in some embodiments, when a request from the system controller 502 is received that is indicative of a desire to enable the gate 518, the power source controller 502 may issue instructions to the auxiliary power supply 506 that cause the auxiliary power supply 506 to gradually reduce the current supplied to the cathode 514 prior to applying a bias to the gate 518 and enabling the gate 518. In this way, the load is gradually reduced prior to the power source 500 entering a substantially non-loaded state. As another example, when a request from the system controller 502 is received indicative of a desire to remove the bias and disable the gate 518, the power source controller 508 may issue instructions to the auxiliary power supply 506 that cause the auxiliary power supply 506 to gradually increase the current supplied to the cathode 514 after the bias has been removed.

Moreover, to reduce wear on the power source 500, for example, in some embodiments, the power source 500 is configured to apply a substantially constant accelerating voltage to the radiation source 504 while the bias is applied to the gate 518 and while the bias is not applied to the gate 518. That is, stated differently, the power source 500 may be configured to apply a same accelerating voltage to the radiation source 504 regardless of whether the gate 518 is enabled (e.g., while the bias is applied) or disabled (e.g., while the bias is not applied). In other embodiments, the power source 500 may apply a first accelerating voltage when the gate 518 is enabled and apply a second accelerating voltage (e.g., reduced voltage) when the gate 518 in disabled, for example.

Figure 6:
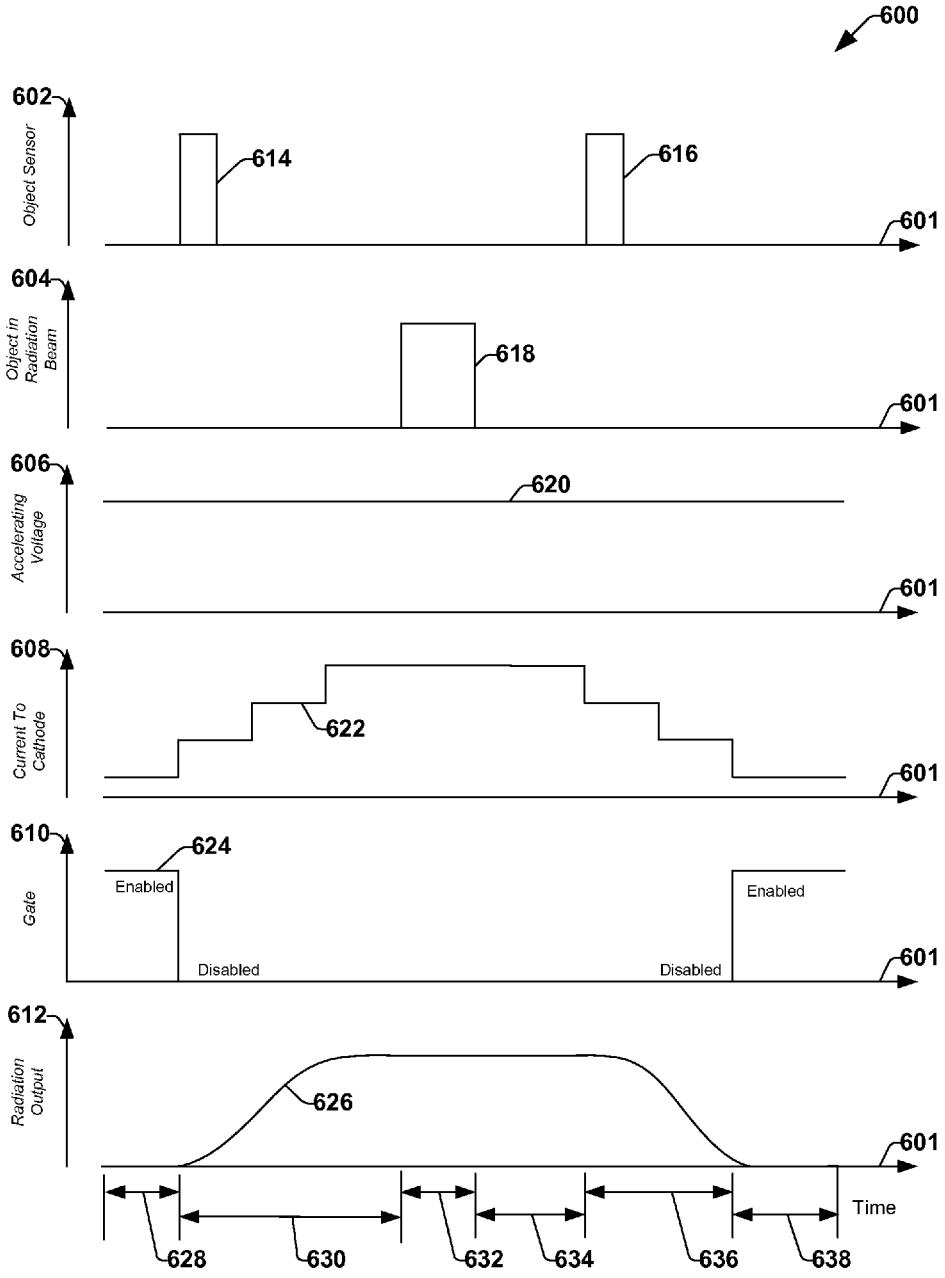
FIG. 6 illustrates an example timing diagram.

FIG. 6 illustrates an example timing diagram 600 describing example operations of various components of a radiation system during an examination of an object. The x-component 601 of the timing diagram 600 represents time (e.g., not drawn to scale). A first y-component 602 relates to measurements yielded from an object sensor. The object sensor emits a first pulse 614 as an object enters a bore of the radiation system, and emits a second pulse 616 as the object exits the bore. Typically, the object sensor is configured to emit the first pulse 614 a few seconds before the object enters an examination region (e.g., where the object exposed to radiation) to allow time for the radiation system to prepare for an examination. Moreover, the object sensor is configured to emit the second pulse 616 a few seconds after the object exits the examination region. Accordingly, the object is not necessarily being examined during the entire window of time between the first pulse 614 and the second pulse 616.

A second y-component 604 relates to the position of the object relative to the examination region (e.g., 112 in FIG. 1). A pulse 618 is shown to illustrate a time window during which the object is in the examination region and is being exposed to radiation. Accordingly, at least a portion of the object is in the path of the radiation beam during the duration of the pulse 618.

A third y-component 606 relates to the accelerating voltage 620 applied to the radiation source (e.g., 504 in FIG. 5). As illustrated, the accelerating voltage 620 remains substantially constant during the interval of time shown. Thus, the accelerating voltage 620 applied when the object is within the examination region is substantially the same as the accelerating voltage 620 applied when the object is not within the examination region.

A fourth y-component 608 relates to an amount of current 622 supplied to the cathode (e.g., 514 of FIG. 5). The amount of current 622 is at a minimum level prior to the object sensor indicating (e.g., via the first pulse 614) that the object has entered the bore. When the object sensor indicates that the object has entered the bore, a power source (e.g., 500 in FIG. 5) begins to gradually increase the current 622 supplied to the cathode until a maximum current is supplied. Typically, the maximum current is reached prior to the object entering the examination region (e.g., as shown by the pulse 618) and remains at the elevated level at least until the object has exited the examination region. In the illustrated embodiment, the power source continues to supply the maximum current until the object sensor indicates, via the second pulse 616, that the object has exited that bore. The power source then proceeds to gradually reduce the current 622 supplied to the cathode until the minimum level is reached. In the example embodiment, the current 622 is transitioned between the minimum level and maximum level in a stair-step fashion. In other embodiments, the current 622 may be transitioned differently. For example, in another embodiment, the current 622 is transitioned in a more linear fashion between the minimum level and the maximum level.

A fifth y-component 610 relates to enabling a gate (e.g., 518 in FIG. 5). When a gate voltage 624 is applied to the gate to bias the gate relative to the cathode, the gate is enabled. When the gate voltage 624 is substantially equal to a cathode voltage applied to the cathode (e.g., which may be 0 V when the cathode is coupled to ground as illustrated in FIG. 5), the gate is disabled. In the illustrated embodiment, the gate is enabled during the interval prior to the first pulse 614 being generated by the object sensor and during an interval after the transition of the current 622 back to a minimum level.

A sixth y-component 612 relates to radiation output 626. As illustrated, when the gate voltage 624 is applied to the gate, causing the gate to be enabled, the radiation output 626 is substantially zero. The radiation output 626 begins to climb when the bias is removed from the gate (e.g., to disable the gate) and the current 622 begins to transition from a minimum level to a maximum level. The radiation output 626 reaches a maximum output when the current 622 reaches a maximum level and remains at the maximum output until shortly after the current 622 begins to transition from the maximum level to the minimum level. When the gate voltage 624 is reapplied and the gate is re-enabled, the radiation output 626 drops to substantially zero.

The x-axis 601 may be broken into six time windows based upon the foregoing operations. During a first time window 628, the gate is enabled and the radiation output 626 is substantially zero. In some embodiments, a calibration component (e.g., 124 in FIG. 1) is configured to perform a first calibration (e.g., dark calibration) during at least a portion of the first time window 628 to acquire one or more offset measurements (e.g., utilized to correct projections and/or images). The first time window 628 ends and a second time window 630 begins when the object sensor identifies that an object has entered the bore. During the second time window 630, the gate is disabled and the radiation system ramps up radiation output 626 by increasing the current 622 supplied to the cathode until a desired radiation output is achieved. The second time window 630 ends and a third time window 632 begins when the object enters an examination region of the radiation system. During the third time window 632, an examination is performed on the object. The third time window 632 ends and a fourth time window 634 begins upon the object exiting the examination region. During the fourth time window 634, radiation continues to be output at a rate similar to the rate at which radiation was output when the object was under examination. Accordingly, in some embodiments, the calibration component is configured to perform a second calibration (e.g., an air calibration) during at least a portion of the fourth time window 634 to acquire one or more gain measurements (e.g., utilized to correct projections and/or images). The fourth time window 634 ends and the fifth time window 636 begins when the object sensor detects that the object has exited the bore. During the fifth time window 636, the radiation system ramps down radiation output 626 by decreasing the current 622 supplied to the cathode until a minimum current level is achieved. The fifth time window 636 ends and a sixth time window 638 begins when the minimum current level is achieved and a gate voltage 624 is reapplied to the gate.

Figure 7:
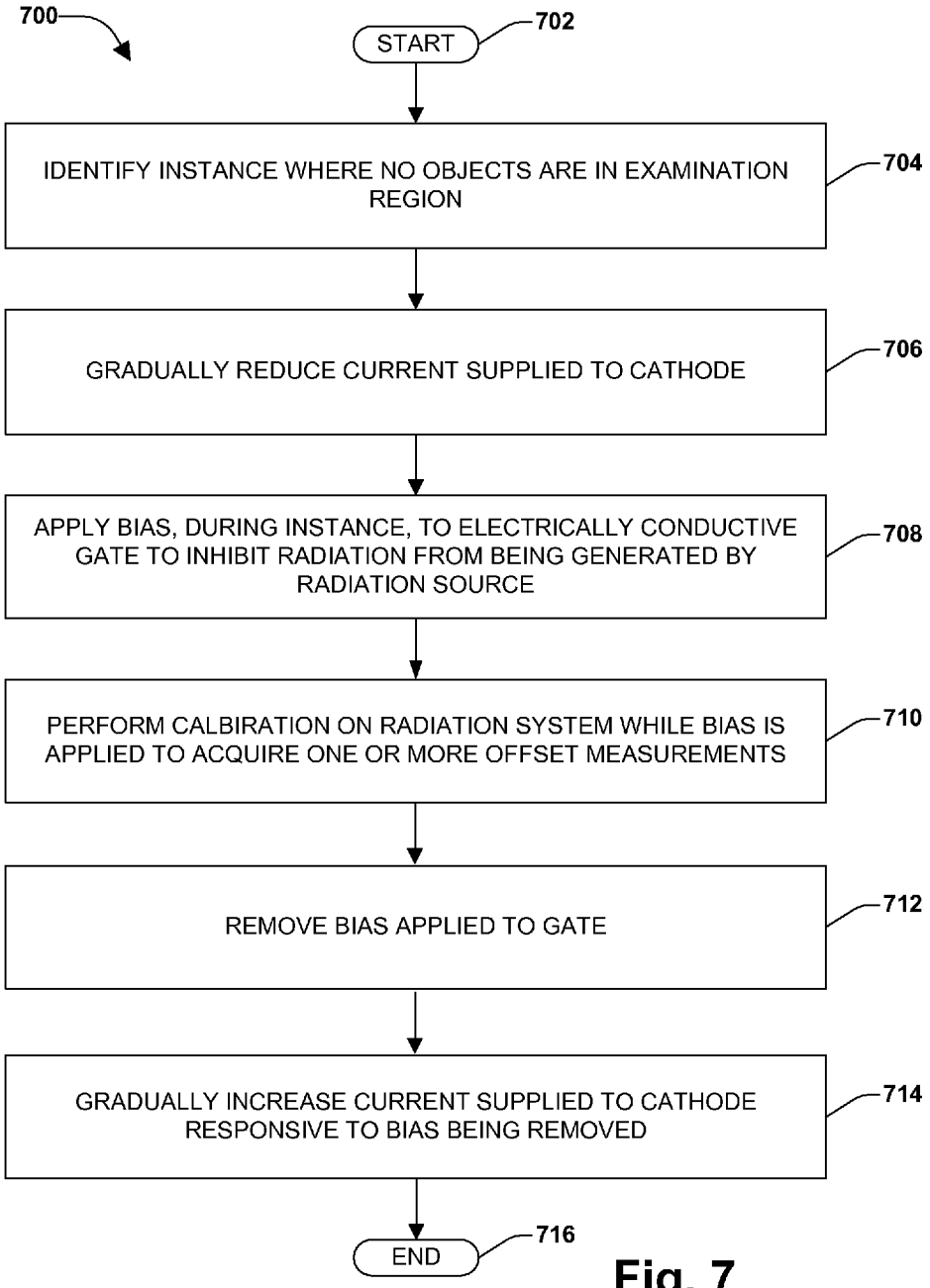
FIG. 7 is a flow chart diagram of an example method for inhibiting radiation from being generated between an examination of a first object and an examination of a second object.

FIG. 7 illustrates an example method 700 for inhibiting radiation from being generated between an examination of a first object and an examination of a second object.

The example method 700 begins at 702, and an instance where no objects are in an examination region of the radiation system is identified at 704. By way of example, in some embodiments, the radiation system comprises one or more object sensors embedded and/or positioned adjacent the radiation system and configured to track a position of one or more objects to be examined relative to the radiation system. Based upon the positions of the one or more objects relative to the radiation system, an instance may be identified where there are no objects in the examination region. In other embodiments, the instance may be identified manually. For example, user input may be provided that indicates a break between an examination of a first object and an examination of a second object.

In some embodiments, identifying the instance further comprises making a determination regarding whether a time interval during which no objects are in the examination region or will be in the examination region warrants inhibiting radiation. By way of example, a short interval of merely a couple seconds may not warrant inhibiting radiation (e.g., because the amount of time to gradually transition the load on a power source exceeds the short time interval during which no objects are being examined). Conversely, an extended interval (e.g., such as 5 seconds or more) may warrant inhibiting radiation.

At 706 in the example method 700, a current supplied to a cathode of the radiation source is gradually reduced to reduce a load on the power source in preparation for a bias being applied to a gate of the radiation source (e.g., which may cause the power source to experience a non-loaded state). For example, as illustrated with respect to FIG. 6, a power source may be configured to reduce current supplied to the cathode in a stair-step manner from a first current to a second current. In other embodiments, the power source may be configured to reduce current supplied to the cathode in a linear manner, logarithmic manner, etc.

At 708 in the example method 700, the bias is applied to an electrically conductive gate of the radiation source during the identified instance to mitigate a flow of electrons between the cathode and the anode, thus inhibiting radiation from being generated by the radiation source. Applying the bias comprises creating a voltage potential between the gate and the cathode by applying a gate voltage to the gate that is different than a cathode voltage applied to the cathode. The voltage potential may be created by altering the cathode voltage, the gate voltage, and/or both. For example, in some embodiments, the bias is applied by altering a gate voltage while maintaining a cathode voltage at a substantially constant value (e.g., which may be 0 V). In other embodiments, the bias is applied by altering the cathode voltage while maintaining a gate voltage at a substantially constant value (e.g., which may be 0 V). In some embodiments, the gate is negatively biased such that a gate voltage applied to the gate is less than a cathode voltage applied to the cathode.

At 710 in the example method 700, a calibration is performed on the radiation system while the bias is applied to the gate to acquire one or more offset measurements. Stated differently, while the bias is applied to the gate, little to no radiation is emitted from the radiation source. Accordingly, the radiation system may be operating under conditions that facilitate performing a dark calibration or offset calibration that is typically performed when the radiation source is powered off. In some embodiments, the one or more offset measurements may be utilized to correct projections and/or images yielded from an examination of objects performed by the radiation system.

At 712 in the example method 700, the bias applied to the gate is removed. That is, the voltage potential between the gate and the cathode is decreased (e.g., to zero) to allow electrons to more freely move between the cathode and the anode of the radiation source. At 714 in the example method 700, the current supplied to the cathode is gradually increased responsive to the bias being removed from that gate at 714. In this way, in some embodiments, the radiation source is gradually transitioned from a non-loaded state when the bias is applied to a fully loaded state when the bias is not applied and when the current supplied to the cathode is at a maximum level. Moreover, by gradually increasing the current supplied to the cathode, an amount of radiation output by the radiation source is gradually increased, for example.

The example method 700 ends at 716.

Figure 8:
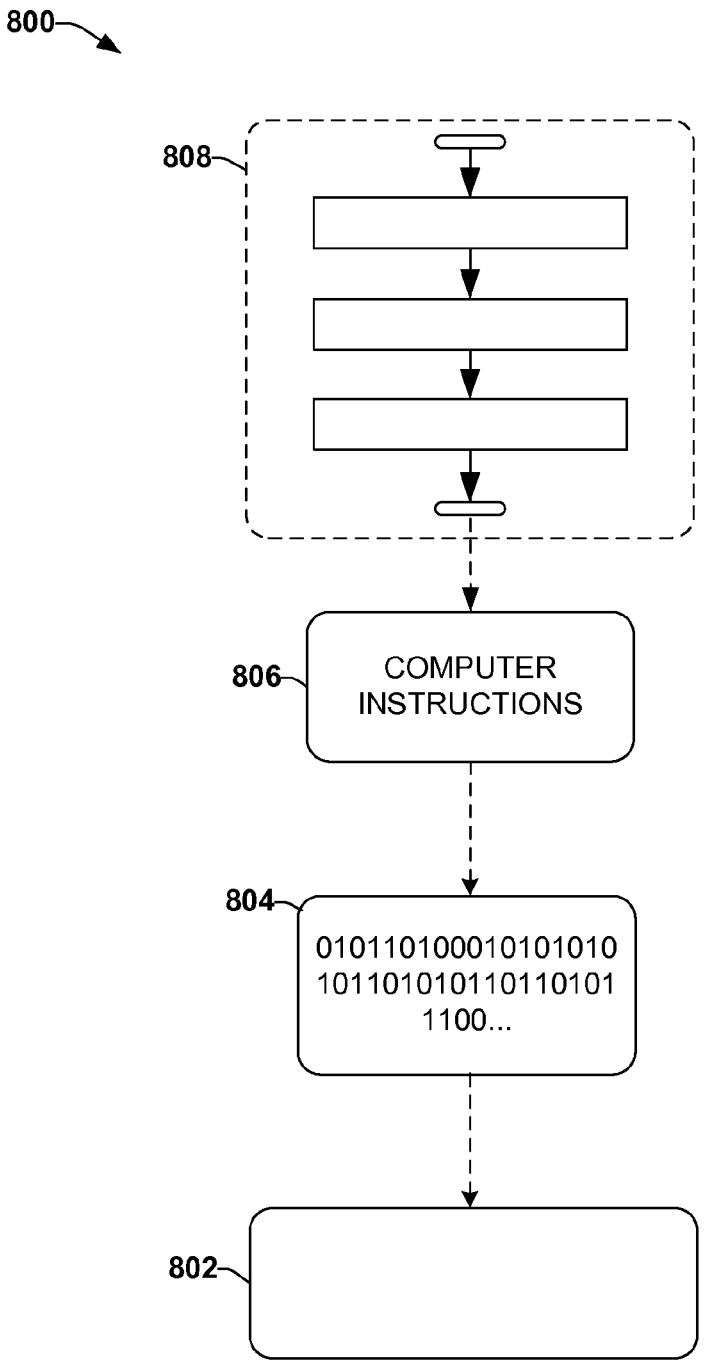
FIG. 8 is an illustration of an example computer-readable medium comprising processor-executable instructions wherein one or more of the provisions set forth herein may be embodied.

Still another embodiment involves a computer-readable medium comprising processor-executable instructions configured to implement one or more of the techniques presented herein. An example computer-readable medium (e.g., memory) that may be devised in these ways is illustrated in FIG. 8, wherein the implementation 800 comprises a computer-readable medium 802 (e.g., a flash drive, CD-R, DVD-R, application-specific integrated circuit (ASIC), field-programmable gate array (FPGA), a platter of a hard disk drive, etc.), on which is encoded computer-readable data 804. This computer-readable data 804 in turn comprises a set of processor-executable instructions 806 which when executed via a processing unit(s) is configured to operate according to one or more of the principles set forth herein. In some embodiments, the processor-executable instructions 806 may be configured to perform a method 808, such as at least some of the example method 700 of FIG. 7, for example. In other embodiments, the processor-executable instructions 806 may be configured to implement a system, such as at least some of the exemplary environment 100 of FIG. 1 and/or the exemplary power source 500 of FIG. 5, for example. Many such computer-readable media may be devised by those of ordinary skill in the art that are configured to operate in accordance with one or more of the techniques presented herein.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used in either the detailed description or the claims, such terms are intended to be inclusive in a manner similar to the term "comprising".

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used in this application, the terms "component," "module," "system", "interface", and the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, those skilled in the art will recognize many modifications may be made to this configuration without departing from the scope or spirit of the claimed subject matter.

Further, unless specified otherwise, "first," "second," and/or the like are not intended to imply a temporal aspect, a spatial aspect, an ordering, etc. Rather, such terms are merely used as identifiers, names, etc. for features, elements, items, etc. (e.g., "a first channel and a second channel" generally corresponds to "channel A and channel B" or two different (or identical) channels or the same channel).

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated example implementations of the disclosure. Similarly, illustrated ordering(s) of acts is not meant to be limiting, such that different orderings comprising the same of different (e.g., numbers) of acts are intended to fall within the scope of the instant disclosure. In addition, while a particular feature of the disclosure may have been disclosed with respect to only one of several implementations, such feature may be combined with one or more other features of the other implementations as may be desired and advantageous for any given or particular application.

What is claimed is:

1. A radiation system, comprising:

an x-ray radiation source comprising:

a cathode;

an anode, the radiation source configured to accelerate electrons between the cathode and the anode to generate radiation; and an electrically conductive gate situated between the cathode and the anode, the electrically conductive gate configured to mitigate a flow of electrons between the cathode and the anode when a bias is applied to the electrically conductive gate, such that a gate voltage applied to the electrically conductive gate is different than a cathode voltage applied to the cathode, to inhibit the generation of radiation from the radiation source; and a power source configured to gradually reduce a current supplied to the cathode,wherein the bias is applied to the electrically conductive gate responsive to the current supplied to the cathode being gradually reduced.

2. The radiation system of claim 1, the bias comprising a negative bias.

3. The radiation system of claim 1, comprising a second power source configured to apply the bias to the electrically conductive gate when an object is not being examined.

4. The radiation system of claim 3, the second power source configured to not apply the bias to the electrically conductive gate when the object is being examined.

5. The radiation system of claim 3, comprising a controller configured to identify when the object approaches an examination region of the radiation system to be examined.

6. The radiation system of claim 1, comprising a second power source configured to maintain a substantially constant accelerating voltage while the bias is applied to the electrically conductive gate and while the bias is not applied to the electrically conductive gate.

7. The radiation system of claim 1, comprising a calibration component configured to perform a first calibration on the radiation system while the bias is applied to the electrically conductive gate to acquire one or more offset measurements.

8. The radiation system of claim 7, the calibration component configured to perform a second calibration on the radiation system while the bias is not applied to the electrically conductive gate to acquire one or more gain measurements.

9. The radiation system of claim 8, comprising a controller configured to identify a window of time, between an examination of a first object and an examination of a second object, sufficient to perform at least one of the first calibration and the second calibration.

10. The radiation system of claim 1, comprising a rotating gantry configured to rotate the radiation source about an axis of rotation.

11. The radiation system of claim 1, the power source configured to gradually increase the current supplied to the cathode responsive to the bias being removed from the electrically conductive gate.

12. The radiation system of claim 1, comprising a second power source configured to apply an accelerating voltage to the anode.

13. A method for inhibiting radiation from being generated between an examination of a first object and an examination of a second object, comprising:

identifying an instance where no objects are in an examination region of a radiation system;

applying a bias, during the instance, to an electrically conductive gate situated between a cathode and an anode of an x-ray radiation source of the radiation system to inhibit radiation from being generated by the radiation source; and in preparation for examining the second object:

removing the bias applied to the electrically conductive gate; and gradually increasing a current supplied to the cathode responsive to the bias being removed from the electrically conductive gate.

14. The method of claim 13, comprising performing a calibration on the radiation system while the bias is applied to the electrically conductive gate to acquire one or more offset measurements.

15. The method of claim 13, the applying comprising applying a gate voltage to the electrically conductive gate that is less than a cathode voltage applied to the cathode to yield a negative bias.

16. The method of claim 13, comprising, prior to applying the bias, gradually reducing the current supplied to the cathode from a first current to a second current.

17. The method of claim 13, the removing the bias applied to the electrically conductive gate comprising:

reducing the bias from a first voltage level to a second voltage level.

* * * * *